US008528786B2

(12) United States Patent
Gates

(10) Patent No.: US 8,528,786 B2
(45) Date of Patent: Sep. 10, 2013

(54) BEVERAGE DISPENSER

(75) Inventor: Matthew Gates, Schertz, TX (US)

(73) Assignee: FBD Partnership, San Antonio, TX (US)

( * ) Notice: Subject to any disclaimer, the term of this patent is extended or adjusted under 35 U.S.C. 154(b) by 35 days.

(21) Appl. No.: 13/368,842

(22) Filed: Feb. 8, 2012

(65) Prior Publication Data

US 2013/0200103 A1 Aug. 8, 2013

(51) Int. Cl.
*B67D 7/78* (2010.01)

(52) U.S. Cl.
USPC ..... 222/145.5; 222/1; 222/129.1

(58) Field of Classification Search
USPC ..... 222/1, 129.1–129.4, 132, 144.5, 222/145.1, 145.5–145.6; 239/423, 428, 429, 239/433
See application file for complete search history.

(56) References Cited

U.S. PATENT DOCUMENTS

| | | | | |
|---|---|---|---|---|
| 3,966,091 | A | 6/1976 | Bencic | |
| 4,194,650 | A * | 3/1980 | Nottke et al. | 222/57 |
| 4,509,690 | A | 4/1985 | Austin et al. | |
| 4,708,266 | A * | 11/1987 | Rudick | 222/105 |
| 4,753,370 | A * | 6/1988 | Rudick | 222/105 |
| 4,932,564 | A | 6/1990 | Austin et al. | |
| 5,033,651 | A | 7/1991 | Whigham et al. | |
| 5,203,474 | A * | 4/1993 | Haynes | 222/129.1 |
| 5,415,326 | A | 5/1995 | Durham et al. | |
| 5,549,222 | A | 8/1996 | Schroeder | |
| 5,685,639 | A | 11/1997 | Green | |
| 5,738,248 | A * | 4/1998 | Green | 222/129.2 |
| 6,047,859 | A | 4/2000 | Schroeder et al. | |
| 6,098,842 | A | 8/2000 | Schroeder et al. | |
| 6,223,948 | B1 | 5/2001 | Davis | |
| 6,253,963 | B1 | 7/2001 | Tachibana | |
| 6,321,938 | B1 * | 11/2001 | Edwards et al. | 222/1 |
| 6,345,729 | B1 | 2/2002 | Santy, Jr. | |
| 6,450,369 | B1 * | 9/2002 | Heyes | 222/129.1 |
| 6,564,971 | B2 | 5/2003 | Heyes | |
| 6,848,600 | B1 | 2/2005 | Crisp, III | |
| 6,877,635 | B2 * | 4/2005 | Stratton | 222/1 |
| 6,880,358 | B2 | 4/2005 | Lucas et al. | |
| 6,983,863 | B2 | 1/2006 | Santy, Jr. | |
| 7,048,147 | B2 | 5/2006 | Roekens et al. | |
| 7,048,148 | B2 | 5/2006 | Roekens et al. | |
| 7,159,743 | B2 | 1/2007 | Brandt et al. | |
| 7,287,671 | B2 | 10/2007 | Morrow, Sr. et al. | |
| 7,383,966 | B2 | 6/2008 | Ziesel | |
| 7,445,133 | B2 | 11/2008 | Ludovissie et al. | |

(Continued)

FOREIGN PATENT DOCUMENTS

CN 200954713 10/2007

*Primary Examiner* — Frederick C Nicolas
(74) *Attorney, Agent, or Firm* — Dicke, Billig & Czaja

(57) ABSTRACT

A beverage dispensing system includes a nozzle body with a plurality of ingredient inlets and a water inlet disposed in the nozzle body. A diffuser is connected to the nozzle body and has floor with a plurality of holes therethrough. A nozzle cap is connected to the diffuser and has an outlet. A first mixing chamber is formed between the ingredient inlets and the diffuser floor, and a second mixing chamber is formed between the diffuser and the outlet, with the second mixing chamber being configured to receive fluid from the first mixing chamber via the holes in the diffuser floor. A first water flow path is situated between the water inlet and the first mixing chamber, and a second water flow path is situated between the water inlet and the second mixing chamber, wherein the second water flow path bypasses the first mixing chamber.

15 Claims, 3 Drawing Sheets

(56) References Cited

U.S. PATENT DOCUMENTS

| | | | | |
|---|---|---|---|---|
| 7,487,887 | B2 | 2/2009 | Ziesel | |
| 7,578,415 | B2 | 8/2009 | Ziesel et al. | |
| 7,665,632 | B2 | 2/2010 | Ziesel | |
| 7,757,896 | B2 | 7/2010 | Carpenter et al. | |
| 7,828,175 | B2 | 11/2010 | Bethuy et al. | |
| 7,866,509 | B2 | 1/2011 | Ziesel | |
| 7,913,879 | B2 | 3/2011 | Carpenter et al. | |
| 7,997,448 | B1 | 8/2011 | Leyva | |
| 8,047,402 | B2 | 11/2011 | Ziesel | |
| 8,083,100 | B2 | 12/2011 | Minard et al. | |
| 8,091,737 | B2 * | 1/2012 | Smeller et al. | 222/145.5 |
| 2005/0072799 | A1 | 4/2005 | Stratton | |
| 2005/0230421 | A1 | 10/2005 | Morrow, Sr. et al. | |
| 2006/0196886 | A1 | 9/2006 | Fox | |
| 2007/0051747 | A1 | 3/2007 | Landers et al. | |
| 2009/0070234 | A1 | 3/2009 | Peters et al. | |
| 2009/0120958 | A1 | 5/2009 | Landers et al. | |
| 2009/0230149 | A1 | 9/2009 | Smeller et al. | |
| 2009/0272274 | A1 | 11/2009 | De Graaff et al. | |
| 2009/0285956 | A1 | 11/2009 | Landers et al. | |
| 2010/0116844 | A1 | 5/2010 | Bissinger | |
| 2010/0224649 | A1 | 9/2010 | Hoover | |
| 2011/0006445 | A1 | 1/2011 | Romanyszyn et al. | |
| 2011/0024455 | A1 | 2/2011 | Bethuy et al. | |
| 2011/0045161 | A1 | 2/2011 | Ziesel | |
| 2011/0049180 | A1 | 3/2011 | Carpenter et al. | |
| 2011/0305807 | A1 | 12/2011 | Koeling et al. | |

* cited by examiner

BEVERAGE DISPENSER

BACKGROUND

Beverage dispensing machines typically produce a beverage by mixing ingredients such as water or carbonated water with a flavoring such as a syrup concentrate. Once mixed, the beverage is dispensed through a nozzle.

Such beverage dispensing machines often have a nozzle for each type or flavor of beverage. Due to counter space restrictions, the number of different beverage offerings may be limited due to the number of nozzles required to dispense the different beverages. To reduce space requirements while providing multiple flavors or types of beverages, other machines dispense multiple different beverages from a single nozzle. Thus, a small number of dispensing nozzles, for example one or two nozzles, can provide a wide variety of drinks.

SUMMARY

A beverage dispensing system includes a nozzle body with a plurality of ingredient inlets and a water inlet disposed in the nozzle body. A diffuser is connected to the nozzle body and has floor with a plurality of holes therethrough. A nozzle cap is connected to the diffuser and has an outlet. A first mixing chamber is formed between the ingredient inlets and the diffuser floor, and a second mixing chamber is formed between the diffuser and the outlet, with the second mixing chamber being configured to receive fluid from the first mixing chamber via the holes in the diffuser floor. A first water flow path is situated between the water inlet and the first mixing chamber, and a second water flow path is situated between the water inlet and the second mixing chamber, wherein the second water flow path bypasses the first mixing chamber.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
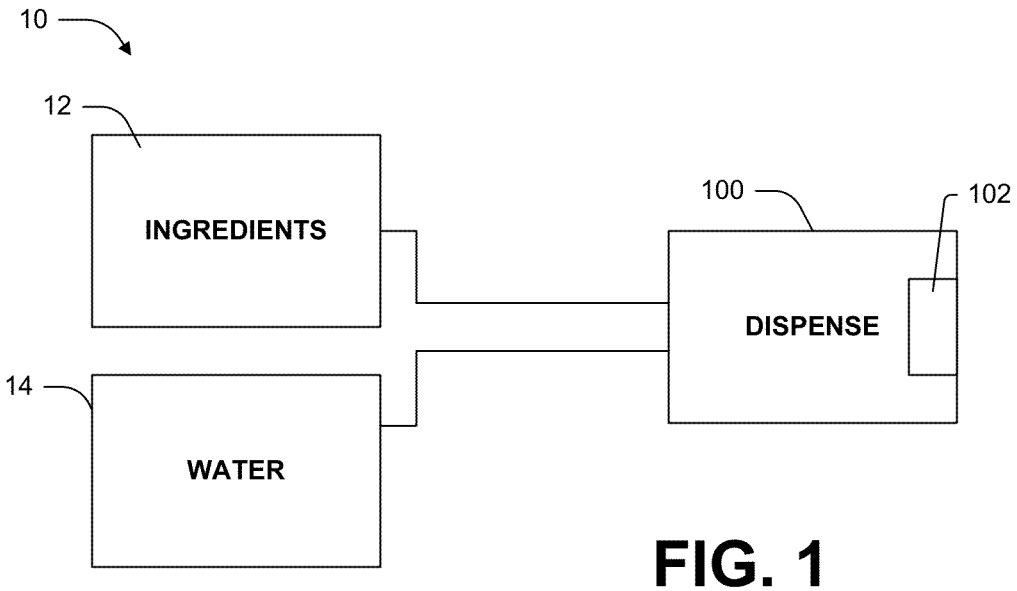
FIG. 1 is a block diagram conceptually illustrating an example of beverage dispensing machine in accordance with aspects of the present disclosure.

FIG. 1 is a block diagram illustrating an example of a beverage dispensing machine system 10. The system 10 includes an ingredient supply 12 for producing a plurality of different beverages. For example, the ingredient supply 12 may include several different syrups for producing multiple drinks, as well as additional flavorings. A source of water 14 is provided for mixing with the desired ingredients from the ingredient supply 12 to produce a desired beverage. In some embodiments, sources of carbonated water and uncarbonated water are provided.

The desired beverage is dispensed from a dispensing system 100 that includes a dispensing valve 102 where the ingredients 12 are mixed with the carbonated or uncarbonated water 14 as the beverage is dispensed from the machine 10. Rather than including a dispensing nozzle for each type of flavor of beverage dispensed, the dispensing valve 102 of the machine 10 provides several different beverages.

Figure 2:
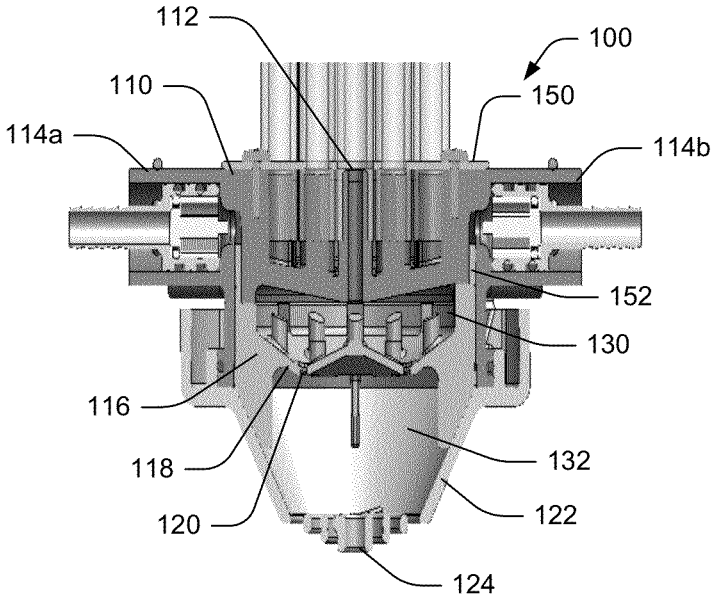
FIG. 2 is a section view of an example of a dispensing system of the machine shown in FIG. 1.
Figure 3:
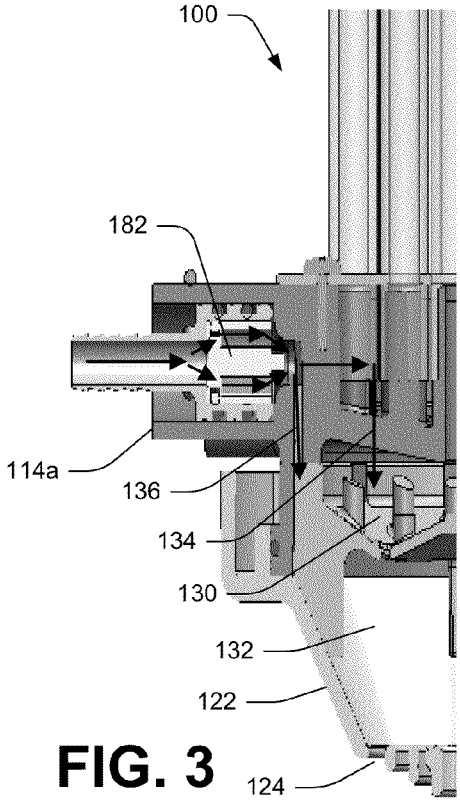
FIG. 3 is a close-up partial view of the dispensing system shown in FIG. 2.

FIG. 2 and FIG. 3 illustrate an example of a beverage dispensing system 100 in accordance with the present disclosure. The system 100 includes a nozzle body 110 with a plurality of ingredient inlets 112 and a water inlet 114 disposed therein for receiving ingredients and water, respectively, into the nozzle body 110. In some embodiments, such as the embodiment shown in FIGS. 2 and 3, both a carbonated water inlet 114*a* and a noncarbonated water inlet 114*b* are provided for producing both carbonated and uncarbonated beverages. For example, 0.25 inch water inlets are suitable. A diffuser 116 is connected to the nozzle body 110, and has a floor 118 with a plurality of holes 120 extending therethrough to form drain ports. A nozzle cap 122 is connected to the nozzle body 110 and diffuser 116, and has an outlet 124 through which the beverage exits the system 100.

A first mixing chamber 130 is formed between the ingredient inlets 112 and the diffuser floor 118, and a second mixing chamber 132 is formed between the diffuser 116 and the outlet 124. The second mixing chamber 132 receives fluid from the first mixing chamber 130 via the holes 120 in the diffuser floor 118. A first water flow path 134 extends between the water inlet 114*a*,114*b* and the first mixing chamber 130, and a second water flow path 136 extends between the water inlet 114*a*,114*b* and the second mixing chamber 132. The second water flow path 136 bypasses the first mixing chamber 130.

Figure 4:
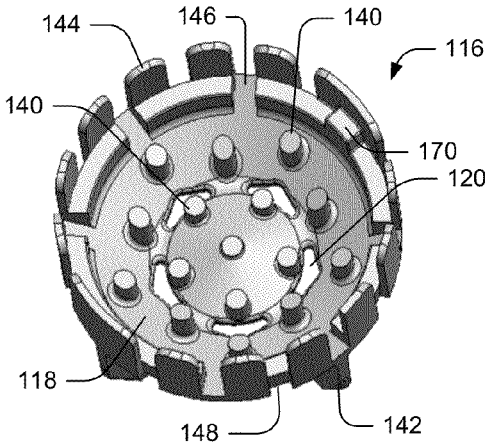
FIG. 4 is a top perspective view of an example of a diffuser of the dispensing system illustrated in FIGS. 2 and 3.
Figure 5:
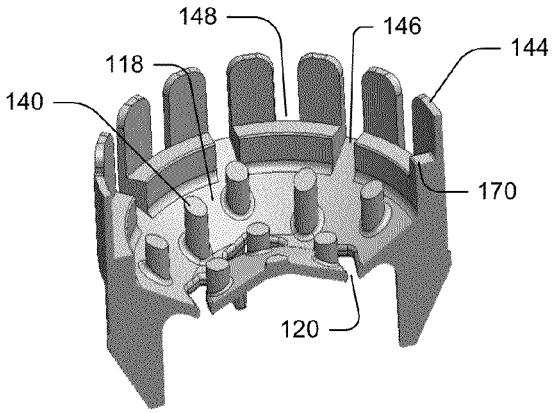
FIG. 5 is a cut-away perspective view of the diffuser shown in FIG. 4.

FIGS. 4 and 5 illustrate an example of the diffuser 116. The diffuser 116 has distribution members 140 extending from the diffuser floor 118 into the first mixing chamber 130. In certain embodiments, the nozzle body 110 is generally cylindrical and has an axis, and the distribution members 140 are also generally cylindrical and each has an axis that extends parallel to the nozzle body axis. The floor 118 of the diffuser 116 slopes towards the holes 120, and top surfaces of the distribution members 140 also are angled to direct the fluid to achieve the desired mixing.

Retention legs 142 are situated about the lower periphery of the diffuser 118 that allow the nozzle cap 122 to press the diffuser 116 into the nozzle body 110, keeping the diffuser 116 in place. In the illustrated example, the nozzle body 110 has a top surface 150 and side surfaces 152 generally perpendicular to the top surface 150 that form the cylindrical body. The ingredient inlets 112 are disposed in the top surface 150 and the water inlets 114*a*,114*b* are disposed in the side surface 152. In alternate configurations, the carbonated and/or uncarbonated may be introduced via water inlets on the top of the nozzle body.

Segmenting plates 144 extend upwardly from the floor 118 about the periphery of the diffuser 116 and define openings between adjacent segmenting plates. Some openings 146 extend into the first mixing chamber 130 to form the first water flow path 134. Other of the openings 148 extend downwardly to the side of the diffuser 116 to form the second water flow path 136, where the first mixing chamber 130 is bypassed and the water flows directly to the second mixing chamber 132.

Figure 6:
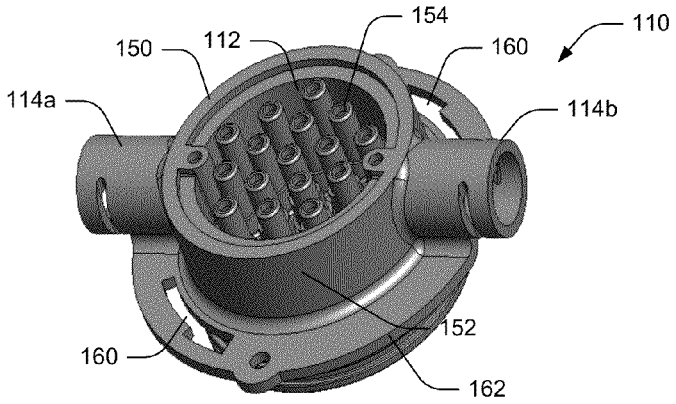
FIG. 6 is a top perspective view of an example of a nozzle body of the dispensing system illustrated in FIGS. 2 and 3.
Figure 7:
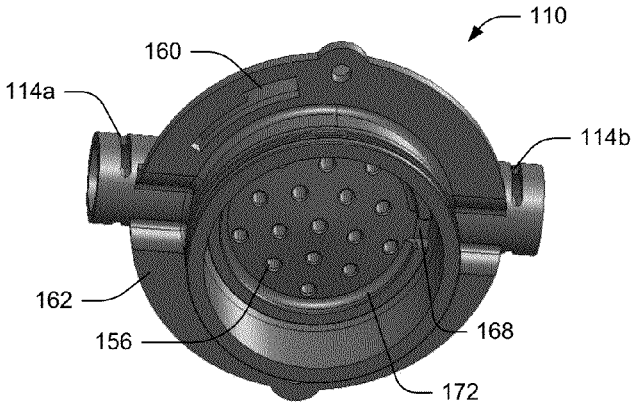
FIG. 7 is a bottom perspective view of the nozzle body illustrated in FIG. 6.

FIGS. 6 and 7 illustrate an example of the nozzle body 110. The ingredient inlets 112 include fittings 154 oriented towards the top 150 of the nozzle body 110 for connecting to the ingredient sources 12. In some embodiments, the ingredients are provided in "bag-in-box" containers that connect to the ingredient fittings 154 via tubes. The opposite ends of the ingredient inlets 112 are ingredient ports 156 where the ingredients flow into the first mixing chamber 132 from the top 150 of the nozzle body 110. In the example illustrated in FIGS. 6 and 7, the nozzle body 110 includes 16 ingredient inlets 112. As shown in FIG. 2, in the illustrated implementation the ingredient inlets 112 are situated directly over the distribution members 140. Thus, there are 16 distribution members 140 corresponding to the 16 ingredient inlets 112 such that the ingredients flow into the first mixing chamber 132 from the top 150 of the nozzle body 110 and strike the corresponding distribution member 140.

The illustrated nozzle body 110 includes openings 160 in a mounting flange 162 configured to receive corresponding locking tabs 166 extending from the nozzle cap 122 to lock the nozzle cap 122, diffuser 116 and nozzle body 110 together. A locating notch 168 is situated in the underside of the nozzle body 110 to receive a corresponding locating key 170 extending from the diffuser to locate the diffuser 116 in the proper orientation relative to the nozzle body 110. A water inlet ring 172 is also defined in the underside of the nozzle body 110 to establish the first flow path 134 from the water inlets 114*a*, 114*b* to the first mixing chamber 132.

Figure 8:
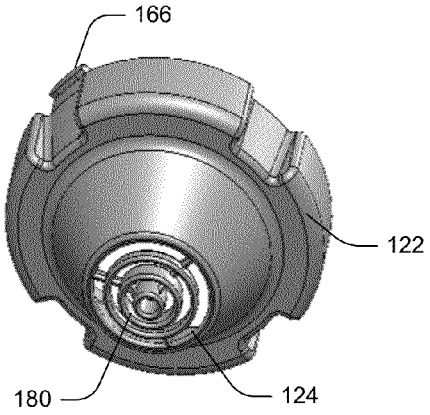
FIG. 8 is a bottom perspective view of an example of a nozzle cap of the dispensing system illustrated in FIGS. 2 and 3.
Figure 9:
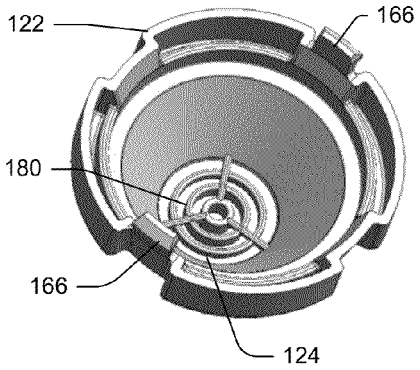
FIG. 9 is a top perspective view of the nozzle cap illustrated in FIG. 8.

FIGS. 8 and 9 illustrate an example of the nozzle cap 122. As noted above, the nozzle cap 122 has locking tabs 166 extending upwardly to engage the openings 160 in the mounting flange 162 to connect the nozzle cap 122 to the nozzle body 110, and press the diffuser 116 into the nozzle body 110 to keep it in place. The illustrated embodiment has concentric straightening rings 180 in the outlet 124 of the nozzle cap.

Thus, the illustrated dispensing system 100 is configured so that ingredients such various syrups and flavorings are introduced through the top 150 of the nozzle body 110 though a generally vertical flow path as viewed in the drawings. The ingredients are dispersed as they flow from the ingredient inlets 112 and impinge on the corresponding distribution members 140 and then into the first mixing chamber 130 created by the mating of the diffuser 116 and nozzle body 110.

Water, both carbonated and uncarbonated depending on drink selected, is introduced via the water inlets 114*a*,114*b* situated on the side 152 of the nozzle body 110 through a generally horizontal flow path as viewed in the drawings, perpendicular to the flow of the final drink product. In the illustrated example, the water flows through check valves 182 integrated into each of the water inlet fittings 114*a*,114*b* thereby maintaining suitable back pressure in the water supply line and preventing excessive residual water drainage. The water then flows into the nozzle body 110. In some embodiments, both carbonated and uncarbonated water inlets 114*a*,114*b* are provided, which allows varying the carbonation level of dispensed product. For an uncarbonated beverage, water is supplied via the uncarbonated water inlet, and for a "fully" carbonated beverage, carbonated water is supplied via the carbonated water inlet. Further, water can be supplied via both inlets 114*a*,114*b* with the flow of water from each inlet being controlled as desired to provide a "partially" or less carbonated beverage.

Spring pressure in the check valves 182 can be adjusted to accommodate varying upstream pressures. The nozzle body 110 contains a cylindrical chamber defined by the sides 152 that surrounds the ingredient inlets 112, and forms the first mixing chamber 130 together with the diffuser 116. The water is allowed to fill this first, or upper mixing chamber 130 via the first water flow path 134, and then to flow downward through the passages 120 in the floor 118 of the diffuser 116 to the second mixing chamber 136 formed by the nozzle cap 112. These passages 120 are sized to minimize $CO_2$ breakout as the water passes from one area of the dispensing system 100 to another.

As noted above, the illustrated nozzle body 110 includes 16 ingredient inlets for ingredients such as various beverage brand syrups, flavor injection syrup, vitamin or energy additives, etc. The ingredient inlets 112 allow product additive to pass through the body 110 of the dispensing system 100 into the first mixing chamber 130. As the product additives pass into the first mixing chamber 130 they impinge axially upon the distribution members 140, which distribute the ingredients radially about the axis of the distribution member 140. The angle of the top surface of the distribution members 140 ensures the product additive is evenly distributed throughout the first mixing chamber 130 where it is pre-mixed with water.

In certain implementations, up to 45% of the incoming water flow (either carbonated or uncarbonated), for example, is diverted into the first mixing chamber 130 via the first water flow path 134. The first water flow path 134 that provides the water to the first mixing chamber 130 is created by the mating of the diffuser 116 and the nozzle body 110, with the openings 146 and the water distribution ring 168. This amount of carbonated or uncarbonated water serves to premix the product additive and cool the product additive minimizing $CO_2$ breakout during drink pour.

After the premixing has occurred in the first mixing chamber 130, the mixed ingredients/water flows to the second mixing chamber 132, passing through the diffuser drain ports 120. These openings, or drains 120 are positioned such that the incoming water and product ingredients cannot immediately drain without interacting in the first mixing chamber 130. The combined areas of the drain openings 120 are greater than the cumulative area of the ingredient inlet ports 172 and openings 146 forming the first water flow path 134 feeding the first mixing chamber 130. This prevents overfilling the first mixing chamber 130, and allows for less residual post mix product to be retained in the first mixing chamber 130.

The first and second water flow paths 134, 136 meet in the second mixing chamber 132 formed by the nozzle cap 122, where the pre-mixed ingredient/water mixture flowing through the openings 148 of the diffuser into the second mixing chamber 169 is injected into the water stream received via the second water flow path 136. The nozzle cap 122 is designed such that the mixing in the second mixing chamber 132 occurs in the last 5% of the nozzle length prior to the mixed drink leaving the outlet 124. The concentric rings 180 situated at the outlet 124 converge the multidirectional streams of water and product additive mix into a unidirectional product flow.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A dispensing device, comprising:

a nozzle body;

a plurality of ingredient inlets disposed in the nozzle body;

a water inlet disposed in the nozzle body;

a diffuser connected to the nozzle body and having floor with a plurality of holes therethrough;

a nozzle cap connected to the diffuser and having an outlet;

a first mixing chamber between the ingredient inlets and the diffuser floor;

a second mixing chamber between the diffuser and the outlet configured to receive fluid from the first mixing chamber via the holes in the diffuser floor;

a first water flow path between the water inlet and the first mixing chamber; and a second water flow path between the water inlet and the second mixing chamber, wherein the second water flow path bypasses the first mixing chamber.

2. The device of claim 1, wherein:

the nozzle body has a top surface and side surfaces perpendicular to the top surface;

the ingredient inlets are disposed in the top surface; and the water inlet is disposed in the side surface.

3. The device of claim 1, wherein the water inlet is a first water inlet, and wherein the device further comprises a second water inlet.

4. The device of claim 3, wherein:

the first water inlet is configured to receive carbonated water; and the second water is configured to receive non-carbonated water.

5. The device of claim 1, wherein:

the diffuser includes a plurality of distribution members extending from the diffuser floor into the first mixing chamber.

6. The device of claim 5, wherein:

the nozzle body is generally cylindrical and has an axis;

the distribution members are generally cylindrical and each has an axis that extends parallel to the nozzle body axis.

7. The device of claim 6, wherein:

the distribution members each have a top surface defining an angle.

8. The device of claim 5, wherein:

the distribution members are each situated directly below a corresponding ingredient inlet.

9. The device of claim 5, wherein:

providing plurality of distribution members includes situating each distribution member directly below a corresponding ingredient inlet.

10. A method, comprising:

receiving a plurality of ingredients into ingredient inlets in a nozzle body;

receiving water into a first mixing chamber in the nozzle body via a first water flow path;

pre-mixing a selected one of the ingredients with the water in the first mixing chamber;

flowing the pre-mixed ingredient and water from the first mixing chamber to a second mixing chamber;

receiving water into the second mixing chamber via a second water flow path that bypasses the first mixing chamber;

dispensing the ingredient and water from the second mixing chamber.

11. The method of claim 10, wherein the pre-mixed ingredient and water from the first mixing chamber flows to the second mixing chamber via holes in a floor of the first mixing chamber.

12. The method of claim 10, wherein the nozzle body has a top surface and side surfaces perpendicular to the top surface; and wherein the ingredients inlets are disposed in the top surface such that the selected ingredient is received into the first mixing chamber from the top surface of the nozzle body through a generally vertical flow path; and the water is received into the side surface of the nozzle body through a horizontal flow path.

13. The method of claim 10, wherein the water is received into the first mixing chamber via first and second water inlets.

14. The method of claim 13, wherein:

carbonated water is received via the first water inlet; and non-carbonated water is received via the second water inlet.

15. The method of claim 12, further comprising:

providing a plurality of distribution members extending into the first mixing chamber such that the ingredients received into the first mixing chamber impinge on the distribution members to distribute the ingredients about the first mixing chamber.

* * * * *